United States Patent [19]

Ginter

[11] Patent Number: 4,692,971

[45] Date of Patent: Sep. 15, 1987

[54] TENSION COMPENSATING WEB EXPANDER ROLLER

[75] Inventor: James F. Ginter, Jupiter, Fla.

[73] Assignee: Spencer-Johnson Company, Appleton, Wis.

[21] Appl. No.: 924,765

[22] Filed: Oct. 30, 1986

[51] Int. Cl.[4] ..... D06C 3/06

[52] U.S. Cl. ..... 26/103

[58] Field of Search ..... 26/101, 102, 103, 104; 29/116 AD; 162/271

[56] References Cited

U.S. PATENT DOCUMENTS 3,672,018 6/1972 Junk et al. ..... 29/116 AD 3,745,625 7/1973 Jaegers et al. ..... 26/103 X 4,487,122 12/1984 George et al. ..... 29/116 AD X

*Primary Examiner*—Robert R. Mackey

*Attorney, Agent, or Firm*—Robert E. Knechtel; Basil E. Demeur

[57] ABSTRACT

A compensating roller for expanding and contracting flexible sheet materials having a curved axle which can be set in any desired plane about a straight axis common to its end support brackets. The curved axle is a three-piece axle having end sections which also are adjustable to both raise and lower and/or to rotate them with respect to the center section of the curved axle whereby the expansion or contraction of the opposite side ends of the web can be more closely controlled to virtually eliminate wrinkling of the side edges.

8 Claims, 7 Drawing Figures

TENSION COMPENSATING WEB EXPANDER ROLLER

BACKGROUND OF THE INVENTION

This invention relates to an improved compensating roll for expanding and contracting flexible materials. Such rolls are used for stretching or contracting webs crosswise of their length and also for removing wrinkles from webs traveling over them.

Compensating rolls of the type to which the invention relates are curved rolls and have a surface of steel or aluminum segments, generally called spool assemblies, which are rotatably mounted on a curved axle. The opposite ends of the curved axle are clamped and are adjustable so that the curved axis of the axle may be set in any desired plane about a straight axis common to both end clamps.

These compensating rolls and the manner of adjustably supporting them such that the curved axis of the axles thereof can be set in any desired plane generally function satisfactorily in stretching or contracting webs crosswise of their length and in removing wrinkles from the webs traveling over them. In many cases, however, it is found that the opposite lateral edges of the web are wrinkled since the webs are not properly expanded or contracted along its edges. These wrinkled edges, therefore, must be severed or otherwise removed. Doing so obviously can create a substantial amount of waste.

Accordingly, it is an object of the present invention to provide an improved compensating roll having end sections which are adjustable whereby more accurate adjustment of the expanding or contracting of the web along the opposite lateral edges thereof can be accomplished so as to virtually eliminate wrinkling of these opposite lateral edges.

The above, as well as other objects and features of the invention, will become apparent from the description below when considered in conjunction with the drawings.

DESCRIPTION OF A PREFERRED EMBODIMENT

Figures 1, 2, 7:
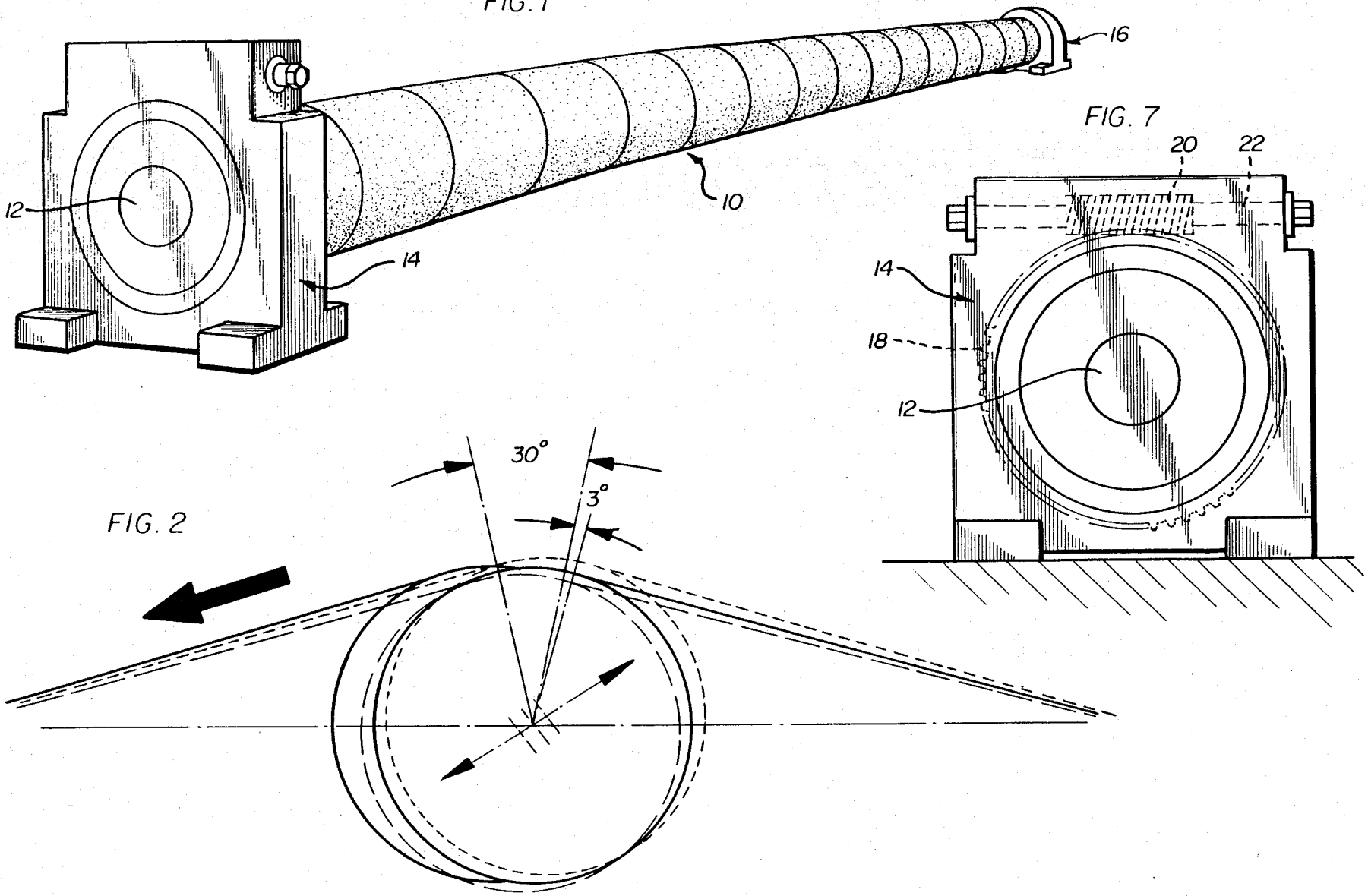
FIG. 1 is a perspective view of a compensating roll exemplary of the invention.
FIG. 2 is a view generally representing the manner in which the compensating roll and its adjustable end sections can be adjusted.
FIG. 7 is a plan view of one of the support brackets illustrating the manner in which the axis of the axle of the curved roll is adjusted to a desired plane.
Figure 3:
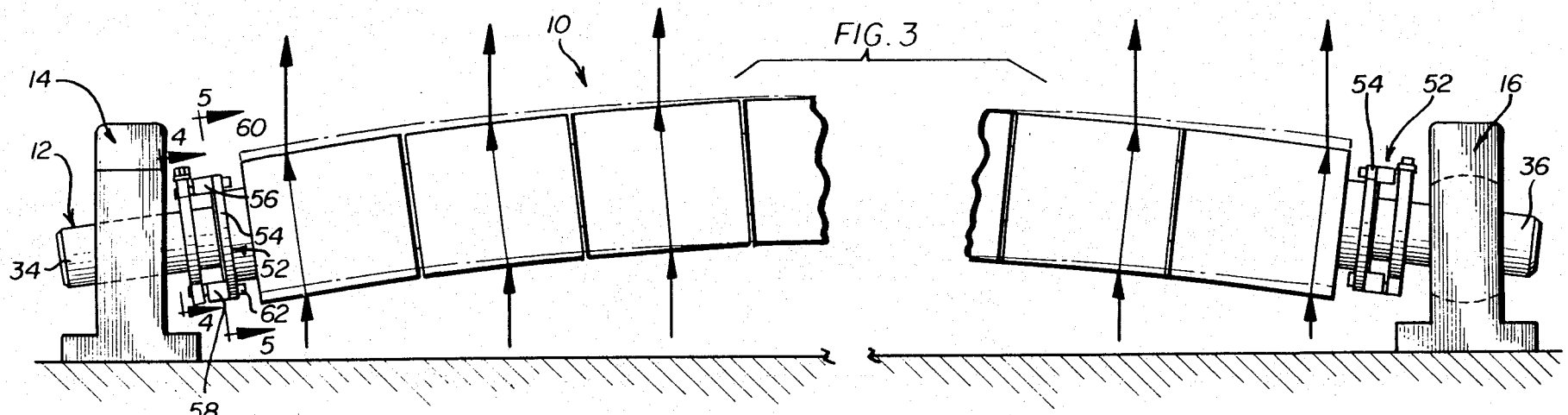
FIG. 3 is a side plan view of the compensating roll.

Referring now to the drawings, there is illustrated a compensating roll 10 having a curved axle 12, the opposite ends of which are adjustably supported by means of a pair of support brackets 14, 16. In this illustrated embodiment, the end of the axle 12 retained within the support bracket 14 has fixedly secured to it a worm gear 18 which is operatively engaged with a complimentary worm gear 20 that is affixed to shaft 22 rotatably disposed in the support bracket 14. The ends of the shaft 22 extend from the support bracket 14 and are formed to receive a wrench or the like for rotating the shaft 22 and, hence, the worm gear 20, which action in turn rotates the worm gear 18. Rotation of the worm gear 18 permits the curved axis of the axle 12 to be set in any desired plane about a straight axis common to both of the end support brackets 14, 16. In this respect, the compensating roll 10 is adjustable, as are the compensating rolls of the prior art.

The compensating roll 10 of the present invention is improved by providing adjustable end sections on it, whereby the expansion or contraction of the web along the opposite lateral edges thereof can be more closely controlled to virtually eliminate wrinkling of these side edges. This is accomplished by effectively providing a three-piece axle 12 which, as can be best seen in FIGS. 5 and 6, includes a center section 30 in the form of a hollow tube 32 and two end sections 34, 36 (only one of which is shown in FIG. 6) in the form of solid steel shafts such as the shaft 38 shown in FIG. 6, which have one end thereof fixedly secured as by welding in the opposed open ends of the hollow tube 32.

A number of annular sleeve sections 42 are rotatably supported by means of spools or spool assemblies 44 on the center section 30, and are secured thereon by means of a pair of threaded collars, such as the threaded collar 46 which is threadedly affixed on the center section 30 and abuts against a bearing 44.

Figure 6:
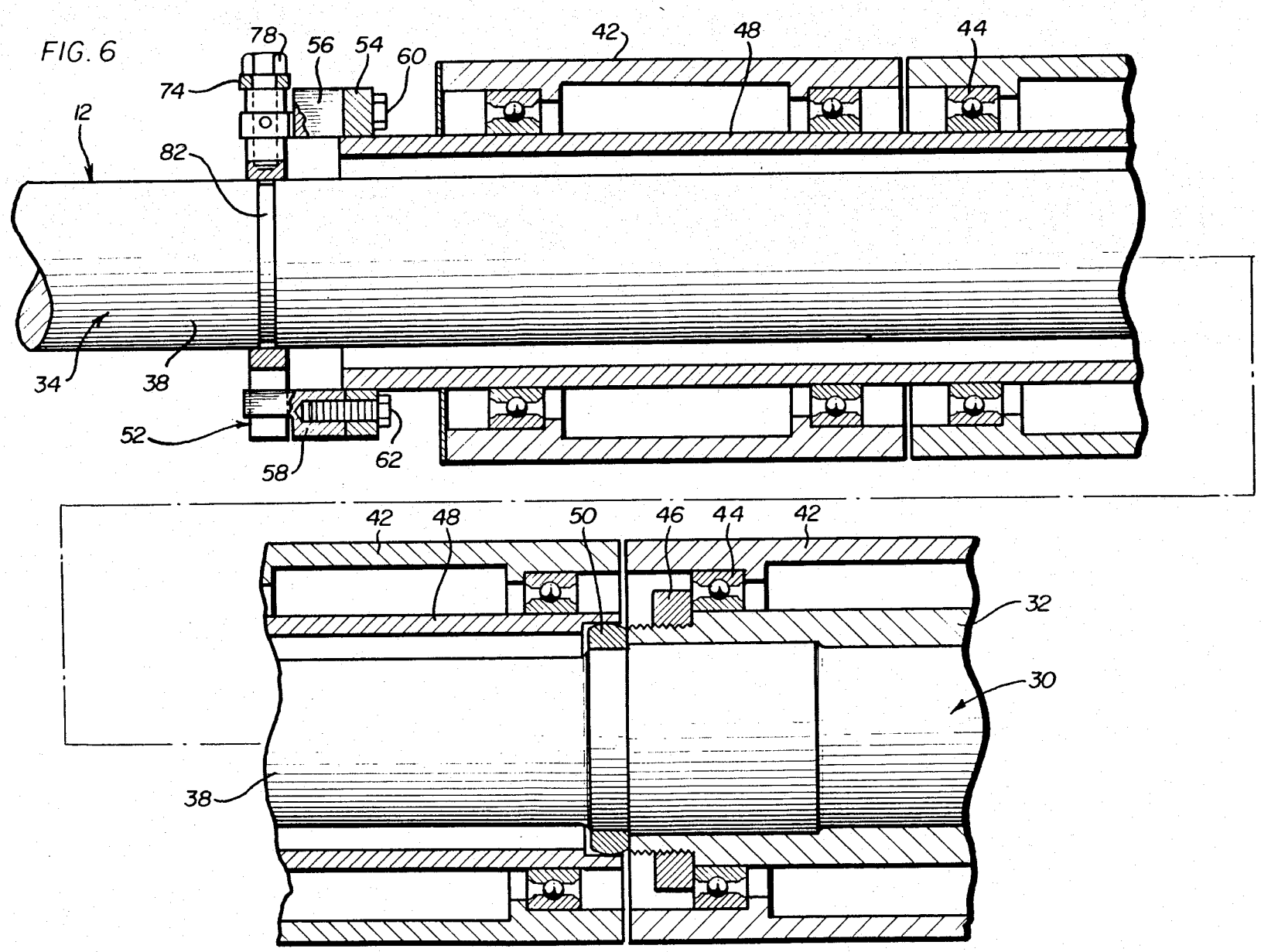
FIG. 6 is a partial sectional view of the compensating roll illustrating one of the adjustable end sections thereof.

Each of the end sections 34, 36 has disposed about it a hollow cylindrical tube, such as the tube 48 shown in FIG. 6 about the end section 34. These tubes 48 are of the same outer diameter as the tube 32 forming the center section 30 and likewise have spool sections 42 rotatably supported thereon.

The hollow cylindrical tubes 48 are supported at their one end about the steel shaft 38 by means of a solid brass bearing or bushing 50 which is affixed to the shaft 38. The outer peripheral surface of the bearing 50 is formed concave so as to provide a pivotal surface, for reasons which will be apparent from the description below. The other ends of the hollow cylindrical tubes 48 are supported by a yoke assembly 52.

Figure 5:
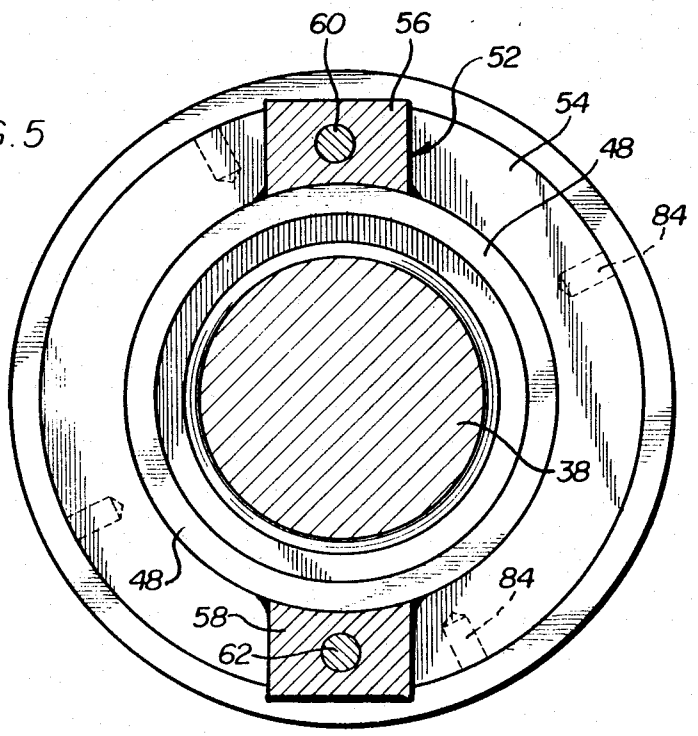
FIG. 5 is a sectional view taken along lines 5—5 of FIG. 3.
Figure 4:
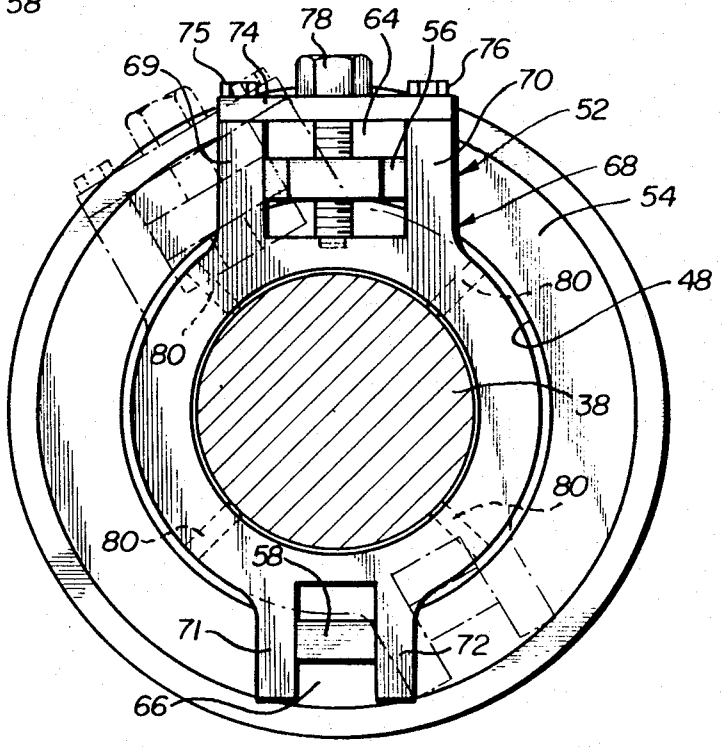
FIG. 4 is a sectional view taken along lines 4—4 of FIG. 3.

This yoke assembly 52, as can be best seen in FIGS. 4–6, includes a collar 54 which is fixedly secured about the end of the hollow cylindrical tubes 48. A pair of slide bars 56, 58 are fixedly secured in diametrically opposed positions to the collar 54, by means of threaded bolts 60, 62. These slide bars 56, 58 are slidably received and disposed within a pair of guide slots 64, 66 of a yoke 68 which is fixedly and rotatably secured about the steel shaft 38. The guide slots 64, 66 are formed by spaced-apart arms 69, 70 and 71, 72, respectively. A plate 74 is secured by means of a pair of threaded bolts 75, 76 across the terminal ends of the arms 69, 70, and has an adjustment screw 78 extended through it and a threaded bore in the slide bar 56, so that the slide bar 56 can be adjustably disposed within the guide slot 64 when the adjustment screw 78 is threadedly manipulated. The yoke 68 is fixedly and rotatably secured in position on the shaft 38 by means of set screws (four illustrated) 80 which threadedly extend through the yoke 68 into a groove 82 machined in the shaft 38. The yoke 68, and hence the tube 48 to which it is secured, can be rotated with respect to the shaft 38 by loosening the set screws 80 and then inserting a tool into one or more of a number (four illustrated) of holes 84 formed in the collar 54. In rotating the tube 48, its end which is disposed about the bearing 50 can freely pivot on the concave surface of the bearing 50.

From the above description of the compensating roll 10, it can be seen that the curved axis of the axle 12 can be set in any desired plane about the straight axis common to both end support brackets 14, 16 by adjustably manipulating the threaded shaft 22 to which the worm gear 20 is affixed. The worm gear 20 is engaged with and thus rotates the worm gear 18 which is affixed to the axle 12. As indicated above, compensating rolls presently are adjustable in one way or another in this fashion to expand or contract the web crosswise of its length and to remove wrinkles from it. Presently available compensating rolls are adjustable only in this fashion, i.e., adjusting the curved axis of the axle in a desired plane about a straight axis common to both end supports thereof. The compensating roll 10 includes adjustable end sections on it whereby the expansion or contraction of the opposite side ends of the web can be more closely controlled to virtually eliminate wrinkling of these side edges. These adjustable end sections are adjusted by threadedly manipulating the threaded screw 78 to the threaded slide bar 56 to adjustably position the latter within the guide slot 64 in the yoke 68. The slide bar 56 and 58 both are secured to the collar 54 which is secured to the tube 48; hence, the slide or guide bar 58 likewise is adjustably positioned within the guide slot 66 in the yoke 68. As can be best seen in FIG. 4 and 6, raising or lowering (as illustrated) the slide or guide bars 56, 58 in this fashion pivotally raises or lowers the end of the tube 48 to displace the tube 48 with respect to the shaft 38 angularly along the length of the tube 48 from the bearing 50 to its opposite terminal end. Accordingly, the stretching or contracting of the opposite side edges of the web can be adjusted by adjustably positioning the tube 48 with respect to the shaft 38 in the described fashion. A still further adjustment of the end sections can be made by rotating the end sections with respect to the axis of the axle 12 (and the shaft 38). The end sections are rotated by loosening the set screws 80 in the yoke 68 and then rotating the collar 54 affixed to the tube 48 by extending an appropriate tool into one or more of the holes 84 in the collar 54. When the tube 48 is adjustably rotated to a desired position, the set screws 80 are again tightened to secure the yoke 68 to the axle 12 (shaft 38). As generally illustrated in FIG. 2, with the compensating roll 10, the wrap angle of the roll can be adjusted within a range of 30 degrees and the end sections can be further adjusted through a plane approximately plus or minus $\frac{3}{8}$ of an inch and can be rotated to provide closer control over the stretching or contracting of the web along its opposite side edges.

What I claim is:

1. A compensating roll for flexible sheet or web material including a curved axle having opposite ends that are supported by a pair or spaced-apart support assemblies, a series of annular spool assemblies rotatably mounted in axially end-to-end relation on said axle, and a series of annular sleeve sections received over said spools, axle adjusting means for adjusting said curved axle such that the axis thereof may be set in any desired plane about a straight axis common to both of said support assemblies, the improvement comprising, a curved axle having a center section and an adjustable end section on each of the opposite ends thereof;

each of said adjustable end sections comprising a shaft coupled to said center section, a hollow cylindrical tube disposed about said shaft, means on said shaft for pivotally supporting one end of said tube, and means on said shaft for adjustably supporting the other end of said tube to adjust said other end with respect to said shaft through the plane of said curved axis of said axle.

2. A compensating roll, as claimed in claim 1, wherein said means on said shaft for adjustably supporting the other end of said tube comprises a yoke having formed thereon a pair of guide slots, a guide bar slidably disposed within each of said pair of guide slots, a collar disposed about said other end of said tube, said guide bars being fixedly secured to said collar and supporting said other end of said tube, and means affixed to at least one of said guide bars for adjustably positioning said guide bars within said pair of guide slots to thereby adjustably position said other end of said tube with respect to said shaft through the plane of said curved axis of said axle.

3. A compensating roll, as claimed in claim 2, further comprising yoke securing and release means for releasably securing said yoke to said shaft whereby said yoke is rotatable thereon to thereby rotate said tube to adjustably rotate the axis of said tube with respect to said shaft and said axle through the plane of said curved axis of said axle.

4. A compensating roll, as claimed in claim 3, wherein said means on said shaft of pivotally supporting one end of said tube comprises a bushing disposed about said shaft and received within the end of said tube, the peripheral surface of said bushing being formed concave to provide a pivotal support for said one end of said tube.

5. A compensating roll, as claimed in claim 3, wherein said means affixed to at least one of said guide bars comprises a threaded bolt extending through a threaded base in said guide bar.

6. A compensating roll, as claimed in claim 3, wherein said shaft has an annular groove formed in it, said yoke securing and release means comprising means extending into said annular groove to releasably secure said yoke to said shaft.

7. A compensating roll, as claimed in claim 6, wherein said means extending into said annular groove comprises at least one set screw.

8. A compensating roll, as claimed in claim 3, wherein said center section of said axle comprises a hollow cylindrical tube, said shafts of said adjustable end sections being solid steel shafts, the ends of said shafts being disposed within and secured to said hollow cylindrical tube.

* * * * *